US006529694B1

(12) United States Patent
Fukaya et al.

(10) Patent No.: US 6,529,694 B1
(45) Date of Patent: Mar. 4, 2003

(54) IMAGE FORMING APPARATUS WITH DENSITY CONTROL

(75) Inventors: Hideaki Fukaya, Chiba (JP); Rintaro Nakane, Yokohama (JP); Shigeru Fujiwara, Yokohama (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/015,639

(22) Filed: Dec. 17, 2001

(51) Int. Cl.[7] ..... G03L 15/00
(52) U.S. Cl. ..... 399/46; 347/140; 399/49
(58) Field of Search ..... 399/38, 42, 43, 399/44, 46, 49; 347/132, 133, 140

(56) References Cited

U.S. PATENT DOCUMENTS 5,351,107 A * 9/1994 Nakane et al. ..... 399/49
5,436,697 A * 7/1995 Negishi ..... 399/46

FOREIGN PATENT DOCUMENTS

JP 6-27775 2/1994
JP 9-292765 11/1997
JP 11-258873 9/1999

* cited by examiner

*Primary Examiner*—Joan Pendegrass
(74) *Attorney, Agent, or Firm*—Foley & Lardner

(57) ABSTRACT

There is disclosed an image forming apparatus in which photosensitive member properties including potential properties of an exposed portion and unexposed portion of the surface of a photosensitive member irradiated with a light beam are estimated. An appropriate contrast potential and a developing bias voltage and charging grid bias voltage suitable for forming a high-density image are determined by a feedback control based on the photosensitive member properties. A laser power is changed to form an intermediate-density image whose density agrees with an intermediate-density target value. When the laser power is changed, the photosensitive member property changes. Therefore, the photosensitive member property is re-estimated, and the developing bias voltage and charging grid bias voltage are set again while maintaining the appropriate contrast potential.

10 Claims, 5 Drawing Sheets

IMAGE FORMING APPARATUS WITH DENSITY CONTROL

BACKGROUND OF THE INVENTION

In conventional image forming apparatuses using an electrophotographic system, such as printers and copying machines, image density fluctuates as a result of fluctuation of environment such as temperature and humidity or a change with an elapse of time. In order to prevent the fluctuation, after a plurality of test patterns of a high/low density region are formed, respective image densities (amounts of an adhered toner) are detected, and a difference from a predetermined target value of each pattern is calculated. A feedback control for repeatedly controlling voltages such as charging voltage and developing voltage is performed until a predetermined image target density is obtained.

However, in the voltage control for correcting the voltage using two points in the high and low density regions as target values, there occurs a problem that a density fluctuation of an intermediate tone cannot exactly be corrected. Particularly in a color copying machine or a color printer, the density fluctuation of the intermediate tone remarkably appears as a change of tone.

An apparatus for performing a potential control or an exposure control of the surface of a photosensitive drum in order to obtain stability of the intermediate density is already known. However, a potential sensor for detecting the potential of the surface of the photosensitive drum of a developing time and a sensor for detecting the amounts of the adhered toner after developing are both mounted in the apparatus. These potential sensors are relatively expensive, and increase the cost of the apparatus.

SUMMARY OF THE INVENTION

An object of the present invention is to provide an image forming apparatus which corrects a density fluctuation of an intermediate tone by an environment fluctuation or a change with an elapse of time without using an expensive potential sensor.

In the present invention, a potential of the surface of a photosensitive drum is estimated based on information of various sensors, and thereby image density including an intermediate density is stabilized without mounting a relatively expensive potential sensor.

According to one aspect of the present invention, there is provided an image forming apparatus comprising: an exposure unit which generates a laser beam corresponding to an image signal; a photosensitive member which is irradiated with the beam generated by the exposure unit and thereby forms an electrostatic latent image; an electric charger to which a charging grid bias voltage is applied and which charges the surface of the photosensitive member with a uniform potential; a developing unit to which a developing bias voltage is applied and which attaches charged toner to the electrostatic latent image formed on the photo-sensitive member to develop the image; an estimating section which estimates photosensitive member properties including a potential property of an exposed portion of the surface of the photosensitive member irradiated with the light beam and a property of an unexposed portion; a contrast potential setting section which sets a contrast potential indicating a difference between the developing bias voltage and an exposed portion potential; an image forming condition setting section which calculates the developing bias voltage and the charging grid bias voltage for achieving the contrast potential based on the photosensitive member property and thereby sets an image forming condition; a high-density pattern forming section which forms a high-density pattern on the image forming condition; a judging section which compares a density of the high-density pattern with a high-density target value and judges agreement of both values; a contrast potential changing section which changes the contrast potential in case of disagreement of both the values; a re-setting section which calculates the developing bias voltage and the charging grid bias voltage for achieving the changed contrast potential based on the photosensitive member property and thereby sets the image forming condition again; and a determining section which repeats operations of the high-density pattern forming section, the judging section, the contrast potential changing section, and the re-setting section to obtain the agreement of the density of the high-density pattern with the target value, and determines the contrast potential, the developing bias voltage, and the charging grid bias voltage for a high density.

According to another aspect of the present invention, there are further provided: an intermediate-density pattern forming section which maintains the determined contrast potential and forms an intermediate-density pattern with a predetermined laser power; a judging section which compares the density of the intermediate-density pattern with an intermediate-density target value and judges the agreement of both the values; a laser power changing section which changes the laser power in case of disagreement of both the values; a re-estimating section which re-estimates the photosensitive member property in response to a change of the laser power; an image forming condition changing section which calculates the developing bias voltage and the charging grid bias voltage for achieving the determined contrast potential based on the photosensitive member property re-estimated by the re-estimating section and thereby changes the image forming condition; and a determining section which repeats operations of the intermediate-density pattern forming section, the judging section, the laser power changing section, the re-estimating section, and the image forming condition changing section to obtain the agreement of the density of the intermediate-density pattern with the intermediate-density target value, and determines the laser power, the developing bias voltage, and the charging grid bias voltage.

DETAILED DESCRIPTION OF THE PREFERRED EMBODIMENTS

Figure 1:
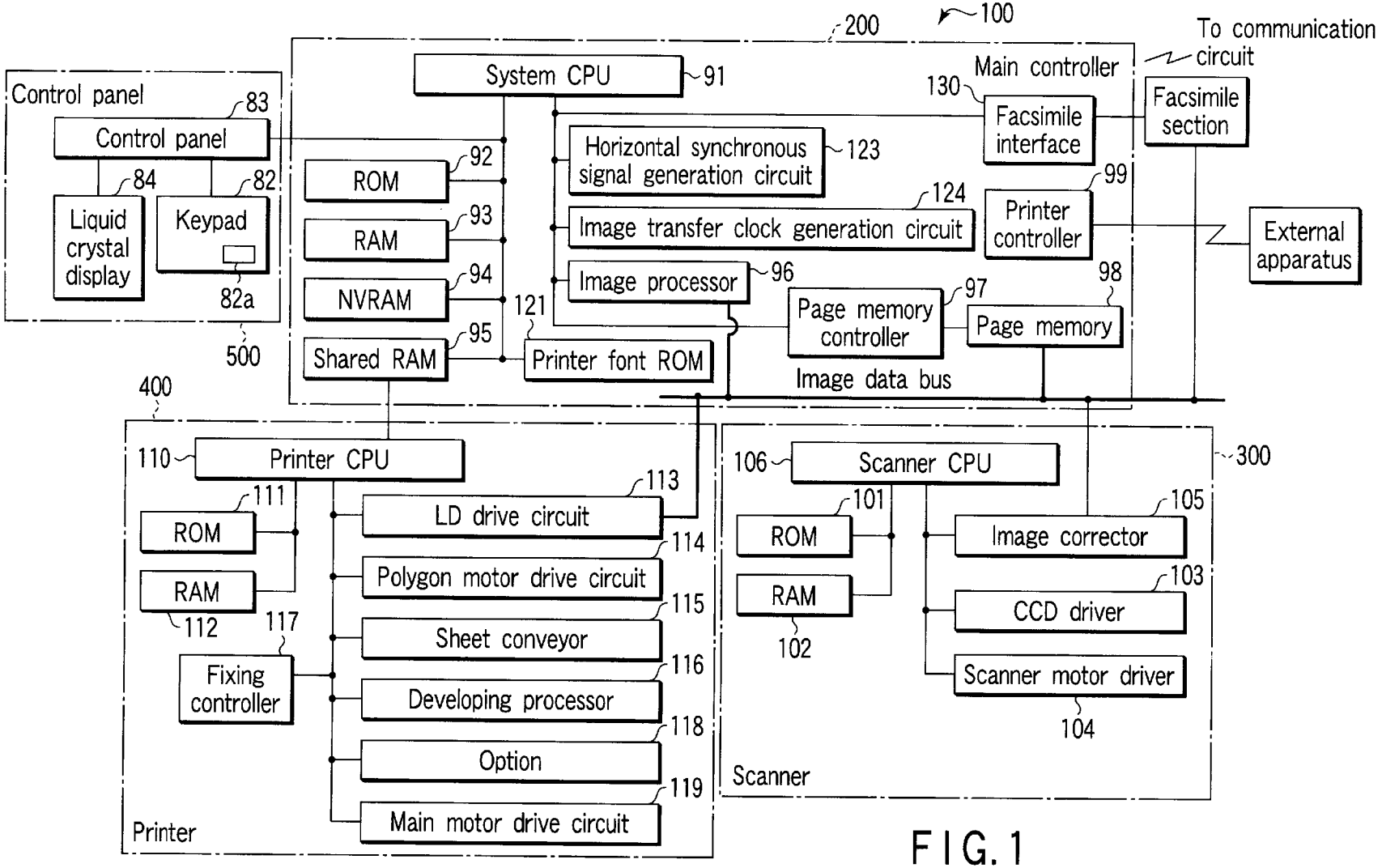
FIG. 1 is a block diagram schematically showing a constitution of a control system of a digital copying machine to which the present invention is applied.

FIG. 1 is a block diagram schematically showing a constitution of a control system of a digital copying machine as an image forming apparatus to which the present invention is applied.

A digital copying machine 100 is constituted of a main controller 200 controlled by a system CPU 91, a scanner 300 controlled by a scanner CPU 106, a printer 400 controlled by a printer CPU 110, and a control panel 500 controlled by a panel CPU 83.

The main controller 200 is constituted of the system CPU 91, a ROM 92, a RAM 93, a NVRAM 94, a shared RAM 95, an image processor 96, a page memory controller 97, a page memory 98, a printer font ROM 121, a horizontal synchronous signal generation circuit 123, an image transfer clock generation circuit 124, and a facsimile interface 130.

Various control programs including the present invention are stored in the ROM 92. The system CPU 91 uses the RAM 93 as an operation area, and controls the whole main controller 200 in accordance with the control program stored in the ROM 92. The system CPU 91 transmits an operation instruction to the printer 400 (printer CPU 110) and scanner 300 (scanner CPU 106), and the printer 400 and scanner 300 return a status to the system CPU 91, The nonvolatile RAM (NVRAM) 94 is a nonvolatile memory backed up by a battery (not shown), and holds data on the NVRAM 94 when power is turned off. Moreover, the NVRAM 94 stores a default value (initially set value) with respect to a hardware element which has a copying (PPC) function, facsimile function, and the like. The shared RAM 95 is used to perform bi-directional communication between the system CPU 91 and the printer CPU 110.

The image processor 96 subjects image data inputted from the scanner 300 or the like to an image processing such as a screen processing, trimming, and masking. The printer font ROM 121 stores font data corresponding to code data such as a character code.

The printer controller 99 receives the code data such as the character code from external apparatuses such as a personal computer via LAN. The printer controller 99 uses font data stored in the printer font ROM 121 to develop the code data and obtain image data with a size and resolution in accordance with data indicating a character size and resolution given to the code data, and stores the data in the page memory 98.

The horizontal synchronous signal generation circuit 123 generates a horizontal synchronous signal synchronized with rotation of a polygon mirror which scans a laser beam for image formation in a main scanning direction. The image transfer clock generation circuit 124 generates an image transfer clock which controls a timing for transferring the image data to a semiconductor laser for image formation.

The page memory controller 97 stores and reads out the image data with respect to the page memory 98. The page memory 98 has a region in which, for example, the image data for two pages can be stored, and is constituted such that the memory can store each page of data obtained by compressing the image data from the scanner 300 or a printer controller 99.

The control panel 500 includes the panel CPU 83, a liquid crystal display 84, and a keypad 82. The keypad 82 includes a copy button 82*a* for instructing a copy operation start, and additionally includes various setting buttons for setting a magnification, the number of sheets to be copied, and the like. The liquid crystal display 84 displays copying conditions including a condition which is set using the keypad 82. The panel CPU 83 controls the liquid crystal display 84 and keypad 82, and transmits the set condition and copy start instruction to the system CPU 91.

The printer 400 includes the printer CPU 110, a ROM 111, a RAM 112, an LD drive circuit 113, a polygon motor drive circuit 114, a sheet conveyor 115, a developing processor 116, a fixing controller 117, an option 118, and a main motor drive circuit 119.

The printer CPU 110 generally controls operation of the printer 400 in accordance with the operation instruction of the system CPU 91. The ROM 111 stores a control program including the present invention, and the RAM 112 is used to temporarily store the data. The LD drive circuit 113 controls the semiconductor laser to turn on/off light emission, and the polygon motor drive circuit 114 controls the rotation of a polygon motor for rotating the polygon mirror.

The sheet conveyor 115 controls conveyance of a sheet along a conveyance path, and the developing processor 116 controls a charging, developing, and transfer processing of a photosensitive drum. The fixing controller 117 controls a fixing unit for fixing a toner image onto the sheet, and the main motor drive circuit 119 controls the rotation of a main motor for rotating the photosensitive drum and a developing roller in a developing unit.

The scanner 300 includes the scanner CPU 106, a ROM 101, a RAM 102, a CCD driver 103, a scanner motor driver 104, and an image corrector 105.

The scanner CPU 106 entirely controls the scanner 300 in accordance with the operation instruction of the system CPU 91. The ROM 101 stores the control program, and the like, and the RAM 102 is used to temporarily store the data. The CCD driver 103 drives a CCD sensor which converts reflected light from an original to an analog electric signal. The scanner motor driver 104 controls the rotation of a driving motor for moving a carriage which scans the original in a sub scanning direction together with an exposure lamp which irradiates the original with light. The image corrector 105 includes an A/D conversion circuit for converting the analog signal from the CCD sensor to a digital signal, and a shading correction circuit for correcting an output fluctuation of the CCD sensor caused by a sensitivity dispersion of the CCD sensor or an ambient temperature change.

Figure 2:
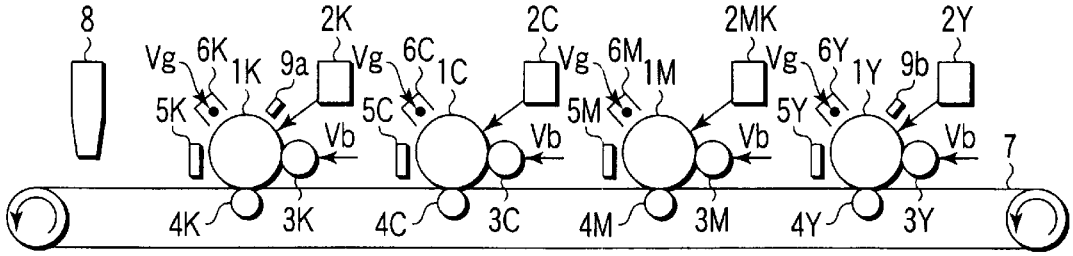
FIG. 2 schematically shows a structure of an electrophotographic processor of a fourfold tandem system digital copying machine according to the present invention.

FIG. 2 is a diagram schematically showing a structure of an electrophotographic processor of the fourfold tandem system digital copying machine 100 according to the present invention.

As shown in FIG. 1, the digital copying machine 100 of the present invention includes the scanner 300 which reads an original image and provides the image data corresponding to the original image, and the printer 400 which forms the image on the sheet based on the image data from the scanner 300. FIG. 2 is a diagram mainly showing the structure of the printer 400, and the structure of the scanner 300 is omitted for simplicity of description.

In the electrophotographic processor of a fourfold tandem system, four sets of a photosensitive drum (hereinafter referred to as a photosensitive member) 1, exposure unit 2, developing unit 3, transfer roller 4, discharger 5, and electric charger 6 for four colors of yellow (Y), magenta (M), cyan (C), and black (K) are arranged in a horizontal direction. In the present embodiment, the tandem system is illustrated as an example, but a color copying machine of a multi-rotation system, or a monochromatic copying machine may be used.

A charging grid bias voltage Vg is applied to a grid of the electric charger 6, and the surface of the photosensitive member 1 is charged by the voltage. The exposure unit 2 irradiates the photosensitive member 1 with the laser beam corresponding to an image signal, and forms an electrostatic latent image on the surface of the photosensitive member. A developing bias voltage Vb is applied to a magnet roller (not shown) disposed in the developing unit 3, and a toner is charged by the bias voltage. The toner adheres to a portion which has a low photosensitive member surface potential with respect to the developing bias voltage Vb. The sheet supplied from a sheet supply section (not shown) is conveyed along a conveyance path 7, and the toner is transferred to the sheet passed between the transfer roller 4 and the photosensitive member 1. A charge remaining on the photosensitive member 1 is eliminated by the discharger 5.

An exposure amount control according to one embodiment of the present invention will be described now. In the following embodiment, the charging grid bias voltage Vg, developing bias voltage Vb, and the like are independently controlled with respect to each color station (one set of the photosensitive member 1, developing unit 3, electric charger 6, and the like).

In the present invention, photosensitive member properties (unexposed portion potential property V0 and exposed portion potential property VL) are estimated based on information of photosensitive member surface temperature obtained from a thermistor 9*a* or 9*b* disposed close to the photosensitive member 1, counter information indicating a photosensitive member rotation operation time, and a laser power of a control start time.

A method for estimating the photosensitive member properties will be described hereinafter.

Figure 3:
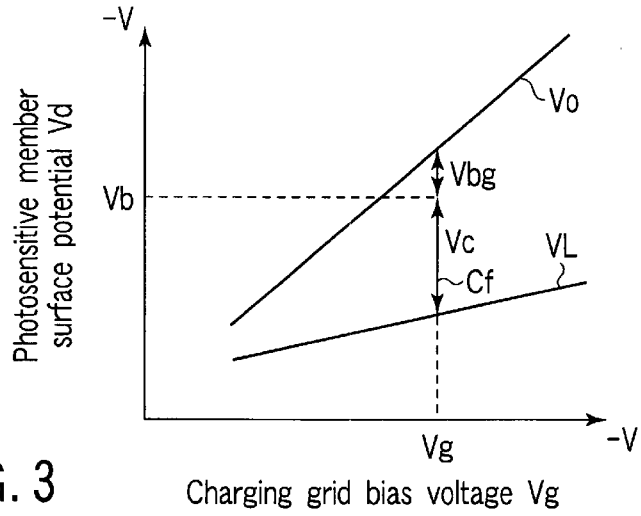
FIG. 3 is an explanatory view of an unexposed portion potential property V0 and exposed portion potential property VL.

A surface potential of the photosensitive member 1 uniformly charged by the electric charger 6 is regarded as an unexposed portion potential V0, and a surface potential of the photosensitive member exposed by the exposure unit 2 and potentially attenuated is regarded as an exposed portion potential VL. FIG. 3 shows the unexposed portion potential property V0 and exposed portion potential property VL, the abscissa indicates the charging grid bias voltage Vg, and the ordinate indicates a photosensitive member surface potential Vd. When an absolute value of the charging grid bias voltage Vg applied to the electric charger 6 increases, both absolute values of the unexposed portion potential V0 and exposed portion potential VL also increase. This relation is nonlinear, but linear approximation results in the following equation.

$$V0=K1\cdot Vg+K2 \text{ (}K1, K2\text{ are constants)} \quad (1)$$

$$VL=K3\cdot Vg+K4 \text{ (}K3, K4\text{ are constants)} \quad (2)$$

Additionally, in the present embodiment, each property is linearly approximated in one straight line, but a plurality of divisions and a plurality of straight lines for respective divisions may be used to perform approximation in accordance with the property of the photosensitive member for use.

The constants K1 to K4 indicate values which depend on the photosensitive member temperature, photosensitive member rotation operation time, exposure strength, and the like. The photosensitive member rotation operation time is a total time of rotations of the photosensitive member till now from or before shipment from a factory, and the exposure strength is a power of laser for exposure.

Figure 4:
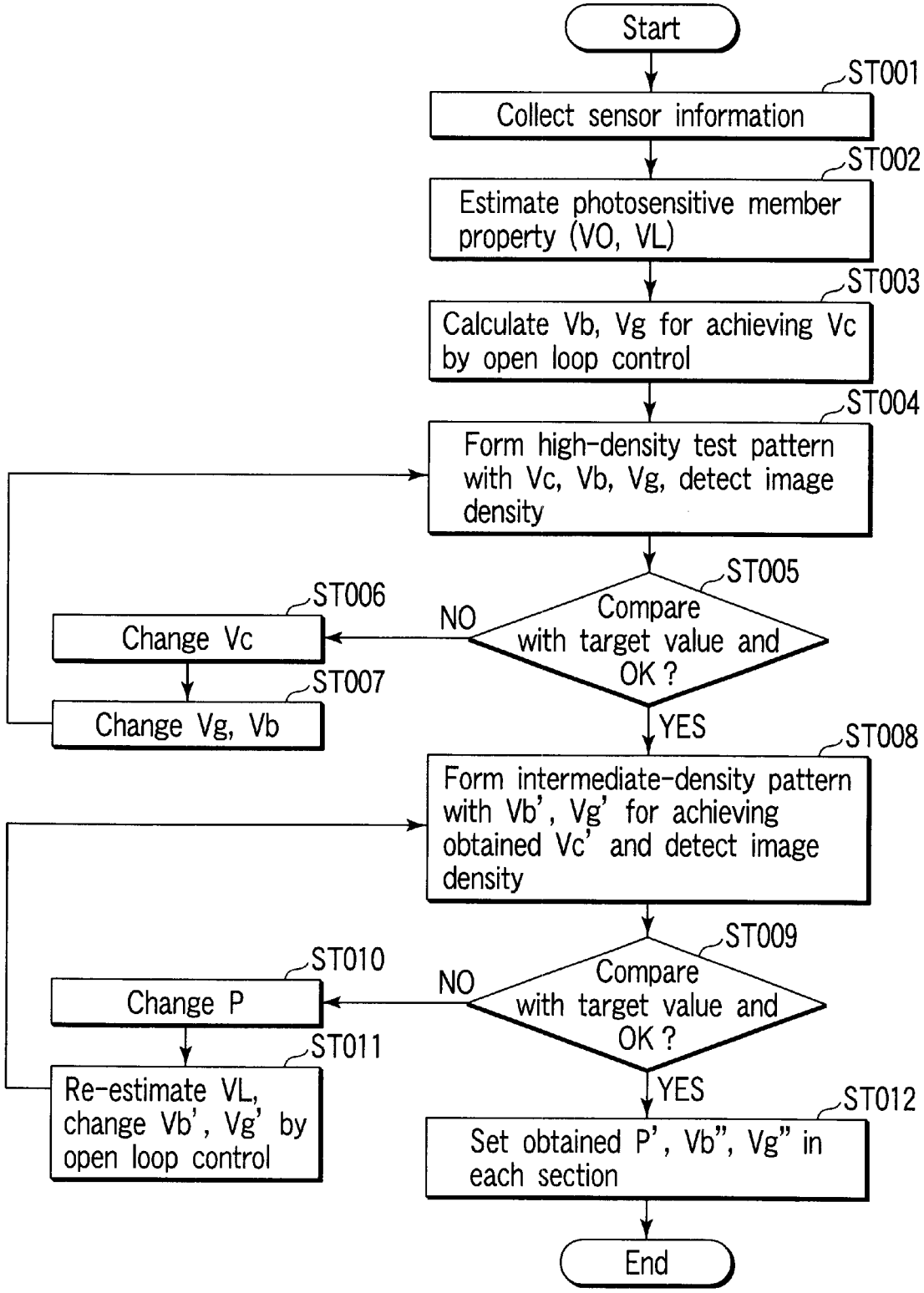
FIG. 4 is a flowchart showing an operation of one embodiment of the present invention.

A photosensitive member property estimation processing operation according to one embodiment of the present invention will be described now. FIG. 4 is a flowchart showing the operation of the present embodiment. Additionally, the following operation is controlled by the system CPU 91 or the printer CPU 110 which responds to the operation instruction of the system CPU 91.

First in step ST001, information of an environment sensor of the apparatus, such as the information of the photosensitive member surface temperature obtained from the thermistor, the counter information of the photosensitive member rotation operation time, and laser power information of the control start time, are collected. Values of the photosensitive member property coefficients K1 to K4 are estimated from this environment sensor information, and the photosensitive member properties (V0, VL) are estimated as shown in FIG. 3 (ST002).

Figure 5:
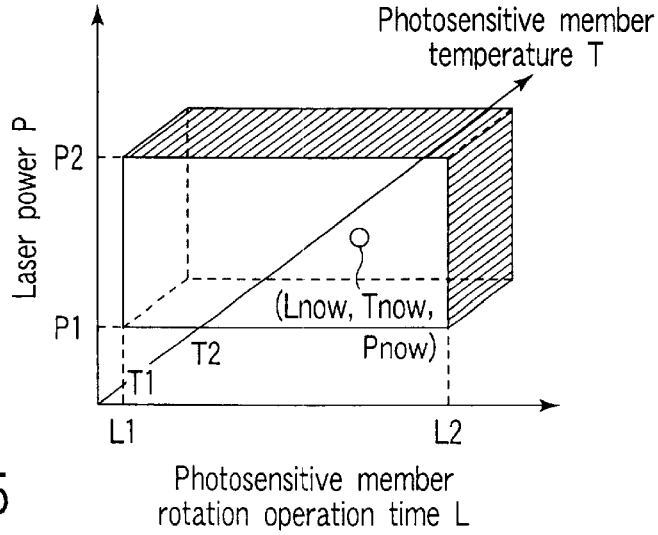
FIG. 5 is an explanatory view of an estimating method of photosensitive member property coefficients K1 to K4.

FIG. 5 is an explanatory view of an estimating method of K1 to K4.

In FIG. 5,

L1: photosensitive member initial rotation operation time (i.e., the photosensitive member rotation operation time from or before the shipment from the factory),

L2: photosensitive member final life rotation operation time (i.e., lifetime of the photosensitive member),

T1: minimum operation temperature of the photosensitive member,

T2: maximum operation temperature of the photosensitive member,

P1: controllable minimum power of laser,

P2: controllable maximum power of laser,

Lnow: photosensitive member rotation operation time in a control time,

Tnow: photosensitive member temperature in the control time, and

Pnow: laser power in the control time.

Moreover, an experiment for changing the environment and laser power is conducted, and thereby the following values of K1 to K4 in the following eight points (eight vertexes of a cube in FIG. 5) are obtained beforehand.

(L1, T1, P1), (L2, T1, P1), (L1, T2, P1),

(L1, T1, P2), (L2, T2, P1), (L2, T1, P2),

(L1, T2, P2), (L2, T2, P2)

The above coefficients of eight points can be used to represent K1 to K4 in the points (Lnow, Tnow, Pnow) of the control time by the following equations.

$$\begin{aligned} Ki\,(Lnow, Tnow, Pnow) = {} & (1-a)\cdot(1-b)\cdot(1-c)\cdot \\ & Ki\,(L1, T1, P1) + a\cdot(1-b)\cdot \\ & (1-c)\cdot Ki\,(L2, T1, P1) + (1-a)\cdot \\ & b\cdot(1-c)\cdot Ki(L1, T2, P1) + \\ & a\cdot b\cdot(1-c)\cdot Ki\,(L2, T2, P1) + \\ & (1-a)\cdot(1-b)\cdot c\cdot Ki\,(L1, T1, P2) + \\ & a\cdot(1-b)\cdot c\cdot Ki\,(L1, T1, P2) + \\ & (1-a)\cdot b\cdot c\cdot Ki\,(L1, T2, P2) + \\ & a\cdot b\cdot c\cdot Ki\,(L2, T2, P2) \end{aligned} \quad (3)$$

$i = 1, 2, 3, 4$

-continued $$a = (Lnow - L1)/(L2 - L1)$$

$$b = (Tnow - T1)/(T2 - T1)$$

$$c = (Pnow - P1)/(P2 - P1)$$

After the photosensitive member properties V0 and VL are estimated, the developing bias voltage Vb and charging grid bias voltage Vg for achieving an initial contrast potential Vc and background potential Vbg in this control are calculated.

Figure 6:
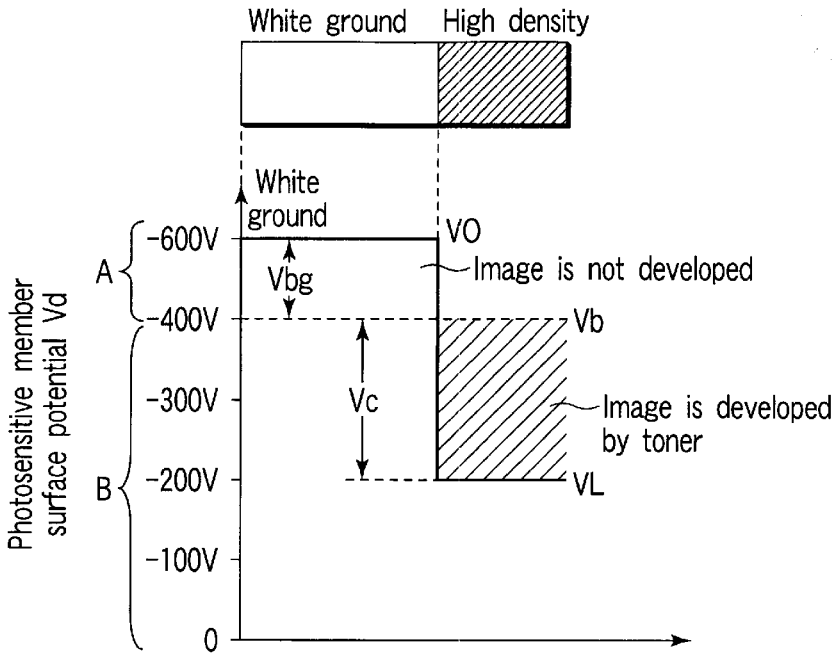
FIG. 6 shows a relation of a photosensitive member surface potential Vd, contrast potential Vc, background potential Vbg, and developing bias voltage Vb.

FIG. 6 is a diagram showing a relation of the photosensitive member surface potential Vd, contrast potential Vc, background potential Vbg, developing bias voltage Vb, unexposed portion potential V0, and exposed portion potential VL. When the developing bias voltage Vb is, for example, −400 V as shown in FIG. 6, no toner adheres to the photosensitive member surface and no image is developed in a photosensitive member surface potential region A on a minus side further from −400 V. In a plus region B from −400 V, the toner adheres to the photosensitive member surface, and the image is developed. The contrast potential Vc is a difference potential of the developing bias voltage Vb and the drum surface potential VL (−200 V in FIG. 6) at which the image is developed with a high density. The background potential Vbg is a difference potential between the unexposed drum surface potential V0 (−600 V in FIG. 6) and the developing bias voltage Vb.

Therefore, the contrast potential Vc and background potential Vbg are represented in the following equations.

$$Vc = Vb - VL \quad (4)$$

$$Vbg = V0 - Vb \quad (5)$$

Figure 7:
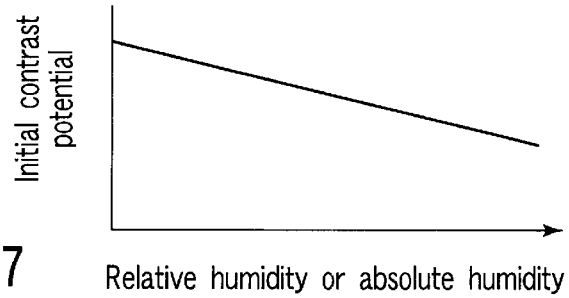
FIG. 7 shows one example of a LUT for use in determining an initial contrast potential Vc.

The initial contrast potential Vc is set to a suitable value (value obtained beforehand by the experiment or the like) stored in the NVRAM 94. Moreover, a lookup table (LUT) set beforehand in the ROM 92 or the ROM 111 may be used to determine the value. FIG. 7 shows one example of the LUT for use in determining the initial contrast potential Vc. The initial contrast potential Vc (content) is stored for a relative humidity, or an absolute humidity (address) obtained from the temperature and relative humidity in the LUT. Usually in a high-temperature high-humidity environment, the toner is easily attached. Therefore, the initial contrast potential Vc is set, for example, to a value which is small in a stepwise manner in proportion to the relative humidity or the absolute humidity. For the background potential Vbg, similarly as the initial contrast potential Vc, a suitable value stored in the NVRAM 94 may be set, or the LUT may be used to obtain the value.

The equation (1) V0=K1·Vg+K2, equation (2) VL=K3·Vg+K4, and equations (4) and (5) representing Vc and Vbg can be used to calculate the developing bias voltage Vb and charging grid bias voltage Vg from the values of the initial contrast potential Vc and background potential Vbq as follows (ST003).

$$Vb = K1 \cdot Vg + K2 - Vbg \quad (6)$$

$$Vg = (Vc + Vbg - K2 + K4)/(K1 - K3) \quad (7)$$

Subsequently, the initial developing bias voltage Vb calculated as described above is applied to the magnet roller of the developing unit 3, the charging grid bias voltage Vg is applied to the grid of the electric charger 6, a high-density test pattern is thereby formed, and an image density is detected by a sensor 8 (ST004) for the amounts of the adhered toner.

In the present embodiment, the density is reproduced by a pulse duration modulation system. That is, the image signal is converted to a pulse duration signal, the laser of the exposure unit 2 is modulated by the pulse duration signal, and the laser beam corresponding to the pulse duration signal is generated. Therefore, when the image signal is, for example, FFh, the whole surface of one pixel is irradiated with the laser beam on the photosensitive member. When the signal is 80*h*, a half region of one pixel is irradiated with the laser beam. In the present embodiment, the high-density test pattern is a pattern in a case in which the image signal of FFh is used to form the image, and an intermediate-density test pattern is a pattern in a case in which the image signal of 80*h* is used to form the image.

Figure 8:
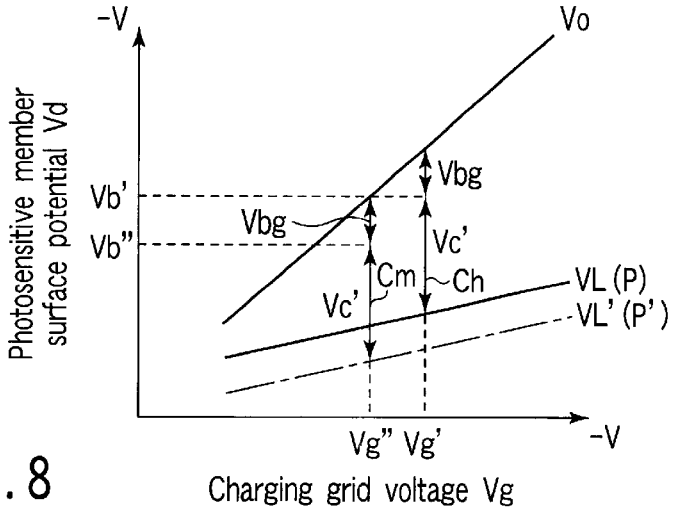
FIG. 8 is an explanatory view of an appropriate contrast potential Vc' and background potential Vbg, and finally determined charging grid voltage Vg" and developing bias voltage Vb".

Subsequently in step ST005, the detected image density is compared with a high-density target value, and it is judged whether the density agrees with the target value. In case of disagreement, the contrast potential is changed to Vc' from Vc so that the image density indicates the high-density target value (step ST006). Further in step ST007, a developing bias voltage Vb' and charging grid bias voltage Vg' for achieving the changed Vc' are obtained as in the equations (6) and (7), and the voltages to be applied to the developing unit 3 and electric charger 6 are set again. The high-density test pattern is formed again on the condition set again as in the step ST004, and a feedback control is repeated until judgment of the step ST005 is successful. The target value is set to an allowable value, and the judgment is successful when the target value is within the allowable value. A line Ch of FIG. 8 shows this state.

After the contrast potential Vc' for achieving the predetermined high-density target value is obtained, an intermediate density is corrected. That is, the intermediate-density pattern is formed (an image for a half of one pixel is formed with an image signal value of 80*h*) on the image forming condition (Vb', Vg') for achieving the obtained Vc' and the image density is detected (ST008). In step ST009, the detected image density is compared with an intermediate-density target value, and it is judged whether the density agrees with the target value. In case of disagreement, a laser power P is changed (ST010). In this case, when the laser power is changed to P' from a power P of the control start time, the exposed portion potential as the photosensitive member property changes to VL' (P') from VL(P) as shown in FIG. 8 (the unexposed portion potential V0 is substantially unchanged). Therefore, when the laser power is changed, in step ST011, an exposed portion property VL' as the photosensitive member property is estimated in an open loop control as in the equations (2) and (3). Further in the step ST011, Vb' and Vg' are changed by the open loop control. That is, a developing bias voltage Vb" and charging grid bias voltage Vg" are obtained based on the estimated exposed portion property VL' and unexposed portion property V0 as in the equations (6) and (7) so that the contrast potential Vc' obtained in the high-density correction control can be maintained.

In the step ST008 the intermediate-density test pattern is formed again with the changed developing bias voltage Vb' (i.e., Vb") and changed charging grid bias voltage Vg' (i.e., Vg") and the image density is detected. The laser power is changed and the feedback control is repeated until the judgment of the step ST009 becomes successful. The target value of the intermediate density is also set to the allowable value. When the target value is within the allowable value, the judgment becomes successful. A line Cm of FIG. 8 shows this state.

The optimum developing bias voltage Vb", charging grid bias voltage Vg", and laser power P' are obtained for the high and intermediate densities as described above, the voltages are applied to the developing unit 3 and electric charger 6 based on these values, and the laser power of the exposure unit 2 is set (ST012). Additionally, the correction control shown in FIG. 4 is automatically performed when the environments such as the operation temperature change, when every predetermined number of sheets, for example, every 1000 sheets are copied, or when a serviceman instructs the control.

In the feedback control, a control time required until the value converges to the target value is lengthened, and a time for which a user cannot use the apparatus sometimes increases remarkably. Moreover, even when the user does not use the apparatus, expendables deteriorate. Therefore, the exposure strength of the control start time is set to a value at which the image density is brought close to a predetermined desired image density, and a feedback control time is thereby shortened.

Figure 9A:
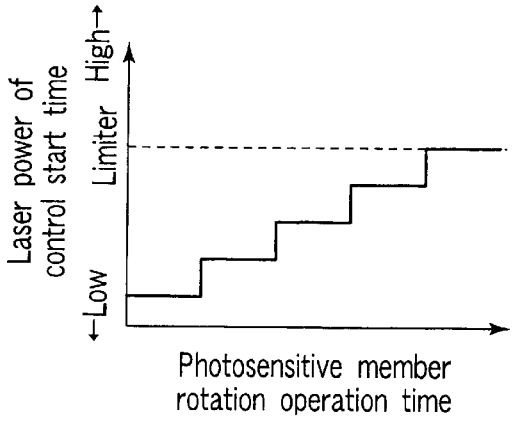
FIGS. 9A to 9C show examples of a lookup table for use in determining a laser power of a control start time.
Figure 9B:
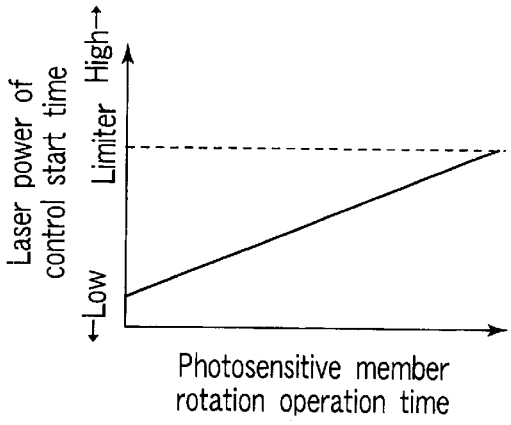
Figure 9C:
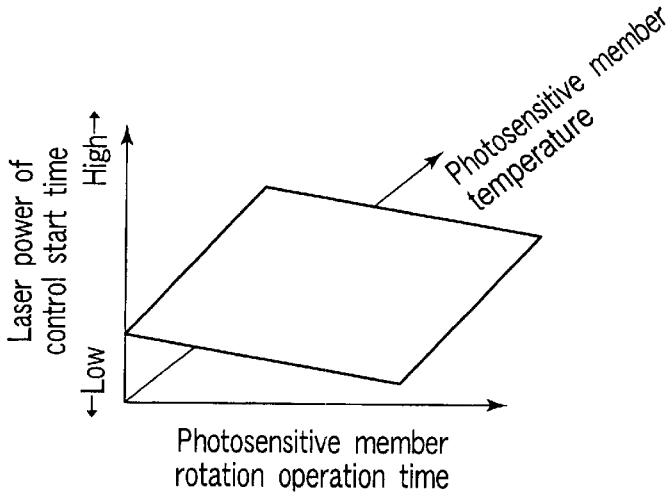

In the present embodiment, the exposure strength (laser power or the like) of the control start time is determined using the LUT. Sensitivity of the photosensitive member deteriorates by long-time use. Therefore, the LUT is set such that the exposure strength is raised in a stepwise manner by the rotation operation time of the photosensitive member as shown in FIG. 9A, or is linearly raised as shown in FIG. 9B. In this case, a setting limiter of the exposure strength may be disposed. Moreover, as shown in FIG. 9C, not only the rotation operation time of the photosensitive member but also an environment change are considered and a photosensitive member temperature, and the like may be added as elements.

Figure 10:
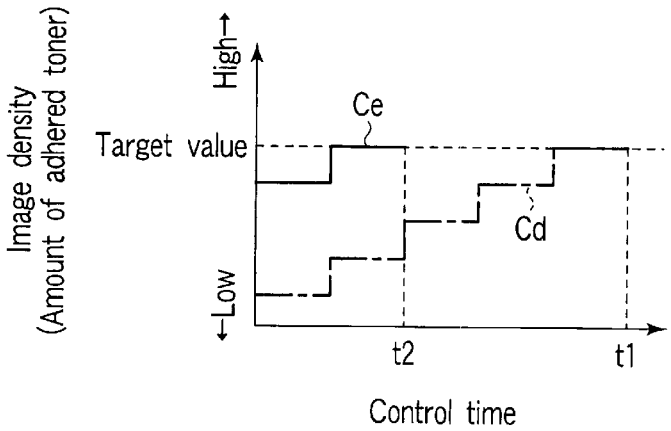
FIG. 10 shows image density changes in a case in which the LUT is used or is not used to control an exposure strength.

FIG. 10 shows a concrete example of the image density (an amount of the adhered toner) in a case in which the LUT is used or is not used to control the exposure strength. A control start exposure amount is set as a fixed value in the photosensitive member which has been used for a long period and whose sensitivity has deteriorated. In this case, as shown by a line Cd, a time required for control convergence is lengthened like a time t1. However, when the start exposure amount is set beforehand to a value close to the target value by the LUT as shown by a line Ce, the time required for the convergence is shortened like a time t2.

Furthermore, in order to shorten the control time, the apparatus may be set so that only the high-density control or only the intermediate-density control is performed. When only the intermediate-density control is performed, the contrast potential Vc' and background potential Vbg are set to the suitable values stored in the NVRAM 94, or the values of the LUT shown in FIG. 7 are used.

What is claimed is:

1. An image forming apparatus comprising:

an exposure unit which generates a laser beam corresponding to an image signal;

a photosensitive member which is irradiated with said beam generated by said exposure unit and thereby forms an electrostatic latent image;

an electric charger to which a charging grid bias voltage is applied and which charges the surface of said photosensitive member with a uniform potential;

a developing unit to which a developing bias voltage is applied and which attaches a charged toner to the electrostatic latent image formed on said photosensitive member to develop the image;

an estimating section which estimates photosensitive member properties including a potential property of an exposed portion of the surface of the photosensitive member irradiated with the light beam and a potential property of an unexposed portion;

a contrast potential setting section which sets a contrast potential indicating a difference between said developing bias voltage and an exposed portion potential;

an image forming condition setting section which calculates the developing bias voltage and the charging grid bias voltage for achieving said contrast potential based on said photosensitive member property and thereby sets an image forming condition;

a high-density pattern forming section which forms a high-density pattern based on said image forming condition;

a judging section which compares a density of the high-density pattern formed by said high-density pattern forming section with a high-density target value and judges agreement of both values;

a contrast potential changing section which changes said contrast potential in case of disagreement of both the values;

a re-setting section which calculates the developing bias voltage and the charging grid bias voltage for achieving the changed contrast potential based on said photosensitive member property and thereby sets the image forming condition again; and a determining section which repeats operations of said high-density pattern forming section, the judging section, the contrast potential changing section, and the re-setting section to obtain the agreement of the density of said high-density pattern with said target value, and determines the contrast potential, the developing bias voltage, and the charging grid bias voltage for a high density.

2. An apparatus according to claim 1, wherein said estimating section changes conditions including an operation temperature and a rotation operation time of said photosensitive member, and a power of a laser for exposure, obtains said photosensitive member property in a plurality of operation points beforehand, and estimates the photosensitive member property in the operation point of a control time based on the photosensitive member property obtained beforehand.

3. An apparatus according to claim 1 further comprising:

an intermediate-density pattern forming section which maintains said contrast potential determined by said determining section and forms an intermediate-density pattern with a predetermined laser power;

a judging section which compares the density of the intermediate-density pattern with an intermediate-density target value and judges agreement of both values;

a laser power changing section which changes said laser power in case of disagreement of both the values;

a re-estimating section which re-estimates said photosensitive member property in response to a change of said laser power;

an image forming condition changing section which calculates the developing bias voltage and the charging grid bias voltage for achieving said determined contrast potential based on the photosensitive member property re-estimated by the re-estimating section and thereby changes th e image forming condition; and a second determining section which repeats operations of said intermediate-density pattern forming section, the judging section, the laser power changing section, the re-estimating section, and the image forming condition changing section to obtain the agreement of the density of said intermediate-density pattern with said intermediate-density target value, and determines the laser power, the developing bias voltage, and the charging grid bias voltage.

4. An apparatus according to claim 3, wherein said predetermined laser power is set by referring to a lookup table in which an appropriate laser power for a photosensitive member rotation operation time is stored beforehand.

5. The apparatus according to claim 3, wherein said predetermined laser power is set by referring to a lookup table in which an appropriate laser power for a rotation operation time and an operation temperature of the photosensitive member is stored beforehand.

6. A density correction method of an image forming apparatus, comprising:

estimating photosensitive member properties including a potential property of an exposed portion of the surface of a photosensitive member irradiated with a light beam and a potential property of an unexposed portion;

setting a contrast potential indicating a difference between a developing bias voltage and an exposed portion potential;

calculating the developing bias voltage and a charging grid bias voltage for achieving said contrast potential based on said photosensitive member property and thereby setting an image forming condition;

forming a high-density pattern on said image forming condition;

comparing a density of the high-density pattern with a high-density target value and judging whether the density agrees with the target value;

changing said contrast potential when the density disagrees with the target value;

calculating the developing bias voltage and the charging grid bias voltage for achieving the changed contrast potential based on said photosensitive member property and thereby setting the image forming condition again; and repeating the steps of forming and judging said high-density pattern, changing the contrast potential, and setting the image forming condition again until the density of said high-density pattern agrees with said target value, and determining the contrast potential, the developing bias voltage, and the charging grid bias voltage for a high density.

7. An method according to claim 6, wherein said step of estimating said photosensitive member property comprises steps of: changing conditions including an operation temperature and a rotation operation time of the photosensitive member, and a power of laser for exposure; obtaining said photosensitive member property in a plurality of operation points beforehand; and estimating the photosensitive member property in the operation point of a control time based on said photosensitive member property obtained beforehand.

8. An method according to claim 6 further comprising steps of:

maintaining said determined contrast potential, and forming an intermediate-density pattern with a predetermined laser power;

comparing the density of the intermediate-density pattern with an intermediate-density target value and judging whether the density agrees with the target value;

changing the laser power when the density disagrees with the target value;

re-estimating said photosensitive member property in response to a change of the laser power;

calculating the developing bias voltage and the charging grid bias voltage for achieving said determined contrast potential based on the re-estimated photosensitive member property and thereby changing the image forming condition; and repeating the steps of forming and judging said intermediate-density pattern, changing the laser power, re-estimating the photosensitive member property, and changing the image forming condition until the density of said intermediate-density pattern agrees with said intermediate-density target value, and determining the laser power, the developing bias voltage, and the charging grid bias voltage.

9. An method according to claim 8, wherein said predetermined laser power is set by referring to a lookup table in which an appropriate laser power for a photosensitive member rotation operation time is stored beforehand.

10. An method according to claim 8, wherein said predetermined laser power is set by referring to a lookup table in which an appropriate laser power for a rotation operation time and an operation temperature of the photosensitive member is stored beforehand.

* * * * *